US007198495B1

(12) United States Patent
Youtsey

(10) Patent No.: US 7,198,495 B1
(45) Date of Patent: Apr. 3, 2007

(54) ELECTRICAL BONDING BLOCK WITH GROUNDING LUG

(76) Inventor: Timothy L Youtsey, 8314 E. Cheery Lynn Rd., Scottsdale, AZ (US) 85251

( * ) Notice: Subject to any disclaimer, the term of this patent is extended or adjusted under 35 U.S.C. 154(b) by 0 days.

(21) Appl. No.: 11/378,302

(22) Filed: Mar. 20, 2006

(51) Int. Cl.
*H01R 13/648* (2006.01)

(52) U.S. Cl. ..... 439/97

(58) Field of Classification Search ..... 439/97, 439/92, 807, 812, 806
See application file for complete search history.

(56) References Cited

U.S. PATENT DOCUMENTS

| | | | | |
|---|---|---|---|---|
| 2,233,216 | A * | 2/1941 | Matthysse | 439/807 |
| 2,304,711 | A * | 12/1942 | Shenton | 439/806 |
| D140,861 | S | 4/1945 | Conlan | |
| 4,159,859 | A | 7/1979 | Shemtov | |
| 4,572,692 | A | 2/1986 | Sauber | |
| 4,619,497 | A | 10/1986 | Vogel et al. | |
| 4,875,864 | A | 10/1989 | Campbell | |
| 5,306,170 | A | 4/1994 | Luu | |
| 5,439,399 | A | 8/1995 | Spechts et al. | |
| 5,632,633 | A * | 5/1997 | Roosdorp et al. | 439/100 |
| 5,829,992 | A | 11/1998 | Merker et al. | |
| 6,011,218 | A | 1/2000 | Burek et al. | |
| 6,048,233 | A | 4/2000 | Cole | |
| D459,306 | S * | 6/2002 | Malin | D13/133 |
| 6,591,055 | B1 | 7/2003 | Eslambolchi et al. | |
| 6,877,996 | B1 * | 4/2005 | Franks, Jr. | 439/92 |
| D508,676 | S | 8/2005 | Franks, Jr. | |

FOREIGN PATENT DOCUMENTS

| | | |
|---|---|---|
| JP | 64-002263 | 1/1989 |

OTHER PUBLICATIONS http://www.tvantenna.com/products/installation/grounding.html, "Pico/Macom GRB-1" and "Pico/Macom GRB-2" single and dual coax cable ground blocks, printed Nov. 1, 2005, two pages.

* cited by examiner

*Primary Examiner*—Alexander Gilman
(74) *Attorney, Agent, or Firm*—Richard C. Litman

(57) ABSTRACT

The electrical bonding block with grounding lug includes a ground wire clamping chock which bears against the ground wire, clamping the ground wire between the chock and the ground wire passage. A ground wire clamp screw engages the chock to pull the chock tightly against the ground wire. This mechanism avoids direct point contact by the contact screw with the ground wire, thereby precluding the formation of nicks and stress risers in the ground wire and subsequent stress corrosion and/or fatigue failure of the ground wire. The device may be adapted to connect virtually any type of electrical conductors having separate ground elements, but is particularly well suited as a bonding block and ground lug for connecting two lengths of coaxial cable.

17 Claims, 6 Drawing Sheets

ELECTRICAL BONDING BLOCK WITH GROUNDING LUG

BACKGROUND OF THE INVENTION

1. Field of the Invention

The present invention relates generally to electrical connectors and the like. More specifically, the present invention relates to an electrical bonding block with a grounding lug for grounding the shielding or other ground of an electrical conductor, e.g., coaxial cable.

2. Description of the Related Art

A number of specialized electrical conductors have been developed in the past, with the various conductors serving various purposes and functions. One type of conductor commonly used for the conduction of relatively high frequency signals (e.g., television and very high frequency radio signals) is the shielded coaxial cable. Such cables essentially include a centrally located relatively thin center conductor enclosed in a relatively thick insulating material, with the insulator in turn being shielded by an electrically conductive shield to prevent interference with any electrical signal being conducted by the conductor. Such cables are commonly installed for household television systems, whether using satellite, cable, or broadcast antenna reception.

Such cable installations universally require connections at various points, such as at the entrance through the wall of the structure. Opposed externally threaded (male) connectors are universally used to connect the two ends of the exterior and interior coaxial cables at this point, with the cable ends generally including captured internally threaded connector nuts or fittings, or sometimes a slip-on attachment over the male threaded connectors. However, some means is also required for grounding the coaxial cable connection. Accordingly, various electrical bonding blocks, as they are known, have been developed, which serve as the connector for two lengths of coaxial cable and which also include some means for connecting the block to an electrical ground.

Quite typically coaxial cables are used to carry an RF signal from an antenna or external cable TV or telephony installation to a radio or television receiver or to a telephone. The center conductor usually carries the signal, and the shield is usually at circuit ground potential. Coaxial cable connectors include a tubular center pin to which the cable center conductor is attached, e.g., by soldering, and the shield is typically clamped to an external shell that encloses insulation surrounding the center pin.

While this arrangement is adequate for carrying the typical low voltage-low current RF signals received at an antenna, typically it is necessary to protect the installation from transient high voltage-high current incidents, such as lightning strikes. Without some form of protection, the transient voltages and currents may be carried by the coaxial cable, with resulting damage to television and radio receivers and other electronic equipment connected to the household wiring, and may potentially start fires by overloading and melting the coaxial cable or household wiring. Consequently, an external ground wire is clamped to the antenna mast and routed to a ground rod or other earth ground, such as metal plumbing pipes. An electrical bonding block is typically mounted to the building or other structure, and has a coaxial cable connector to connect coaxial cables in series, and a clamp to secure the external ground wire, which may be solid wire or stranded wire, and may be copper wire, aluminum wire, or the like. The shield of the coaxial cable is connected to the ground wire through the bonding block.

Grounding the coax shield is often supplemented by using a lightning arrestor in the coax line between the antenna and the receiver or other electronic equipment.

Typically, such conventional electrical bonding blocks have a ground wire passage with a screw or bolt installed radially to the ground wire passage. The screw or bolt is tightened directly against the ground wire inserted in the passage, to form an electrical connection to ground. The problem with such direct engagement is that the relatively small "point" area of contact of the tip of the grounding screw with the ground wire causes the ground wire to deform at that point, and nearly always induces a "stress riser" in the wire, which weakens the wire at that point. This is particularly true where relatively soft metal (e.g., copper or aluminum) is used for the ground wire. Slight movement of the wire relative to the grounding lug will always occur over time, with such movement working the wire about the sharp engagement of the ground screw therewith and the stress riser. This eventually work hardens the ground wire, making it brittle, and weakens the ground wire sufficiently that it breaks. Even before breakage, stress corrosion often occurs in the stress riser formed in the ground wire, which increases the electrical resistance of the connection well beyond desired limits.

A few electrical grounding devices have been developed in the past that avoid the direct contact of the tip of a screw or bolt with the ground wire. An example of such a device is found in Japanese Patent Publication No. 64-2263, published on Jan. 6, 1989. This device uses a rectangular washer with downwardly folded corners, which engage the ground wire(s). A central screw tightens the washer against the ground wire(s). The result is similar to that described above with conventional screw type ground wire clamps, i.e., a relatively sharp point contact (in this case, the sharp edge or corner of the washer) engages the ground wire and likely nicks the wire to create a stress riser.

None of the above inventions and patents, taken either singly or in combination, is seen to describe the instant invention as claimed. Thus, an electrical bonding block with grounding lug solving the aforementioned problems is desired.

SUMMARY OF THE INVENTION

The electrical bonding block with grounding lug includes a connector for connecting two otherwise separate electrical conductors and further electrically bonding their ground or shielding elements to an electrical ground integral with the electrical conductor connecting means. The electrical ground connection comprises a ground wire passage through a grounding lug portion of the device, with a ground wire clamp screw axially offset from the ground wire passage. The screw engages a ground wire clamp chock and pulls the chock against a ground wire inserted in the passage, clamping the ground wire between the chock and the passage walls.

Numerous embodiments of the electrical bonding block are provided for herein. The connector for the connection of electrical conductors may comprise opposed identical male threaded coaxial connectors, or connectors for other types of electrically grounded conductors. The connectors may be directly opposed to one another, or may be installed at right angles (or other non-linear relationship) to one another. The ground wire passage may be parallel to the axis of one or both of the electrical conductor connectors, or may be at a right angle (or other angle) thereto. The ground wire clamp chock may comprise a straight, flat, beveled surface, or may include a concave form more closely conforming to the curvature of the wire. The ground wire passage may include a generally semicircular side opposite the chock, which extends completely across or through the ground wire passage to provide a greater surface contact area for the ground wire. The ground wire clamp screw may be cantilevered through the upper portion of the grounding lug, or may have its distal end captured within a support passage.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of an electrical bonding block with a grounding lug, adapted for mechanically and electrically connecting two electrical conductors and electrically grounding the ground members thereof. While the electrical bonding block may be adapted for the connection and grounding of virtually any type of electrical conductor, it is particularly well suited for use in connecting and grounding coaxial cable conductors.

Figure 1:
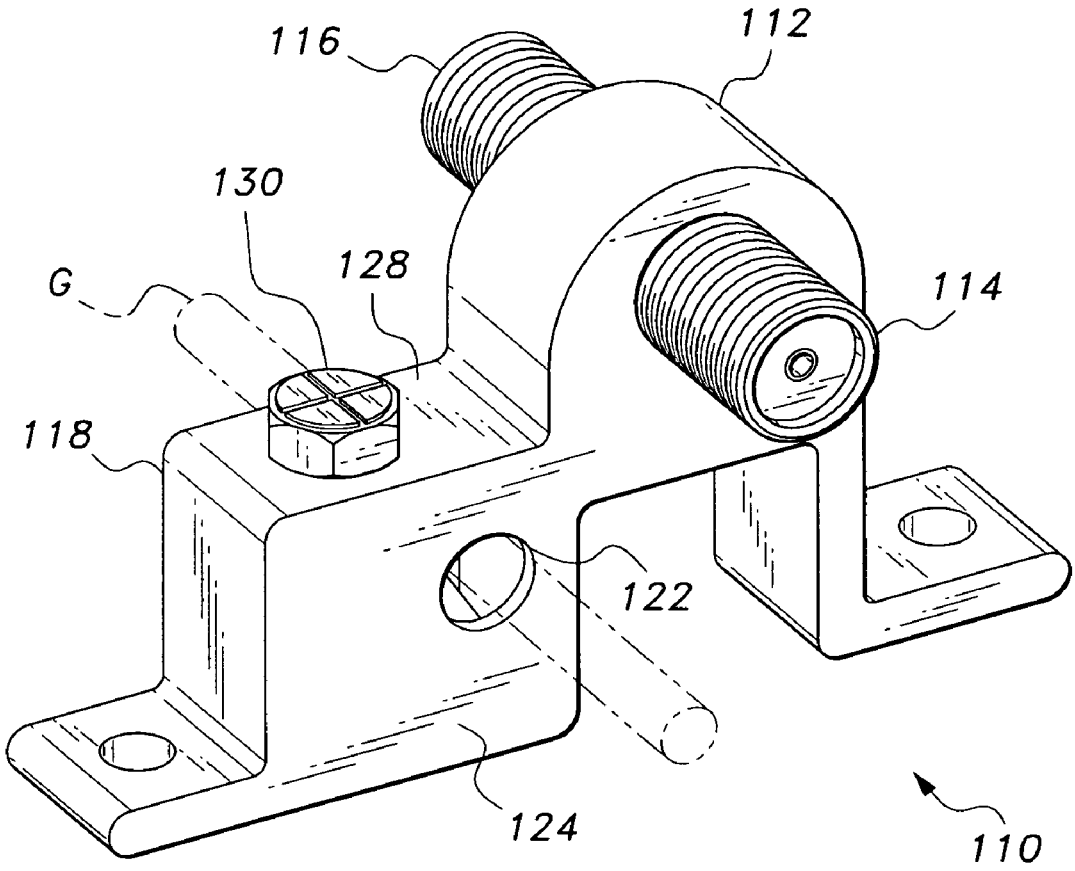
FIG. 1 is an enlarged perspective view of an electrical bonding block with grounding lug according to the present invention, showing its general configuration.
Figure 2:
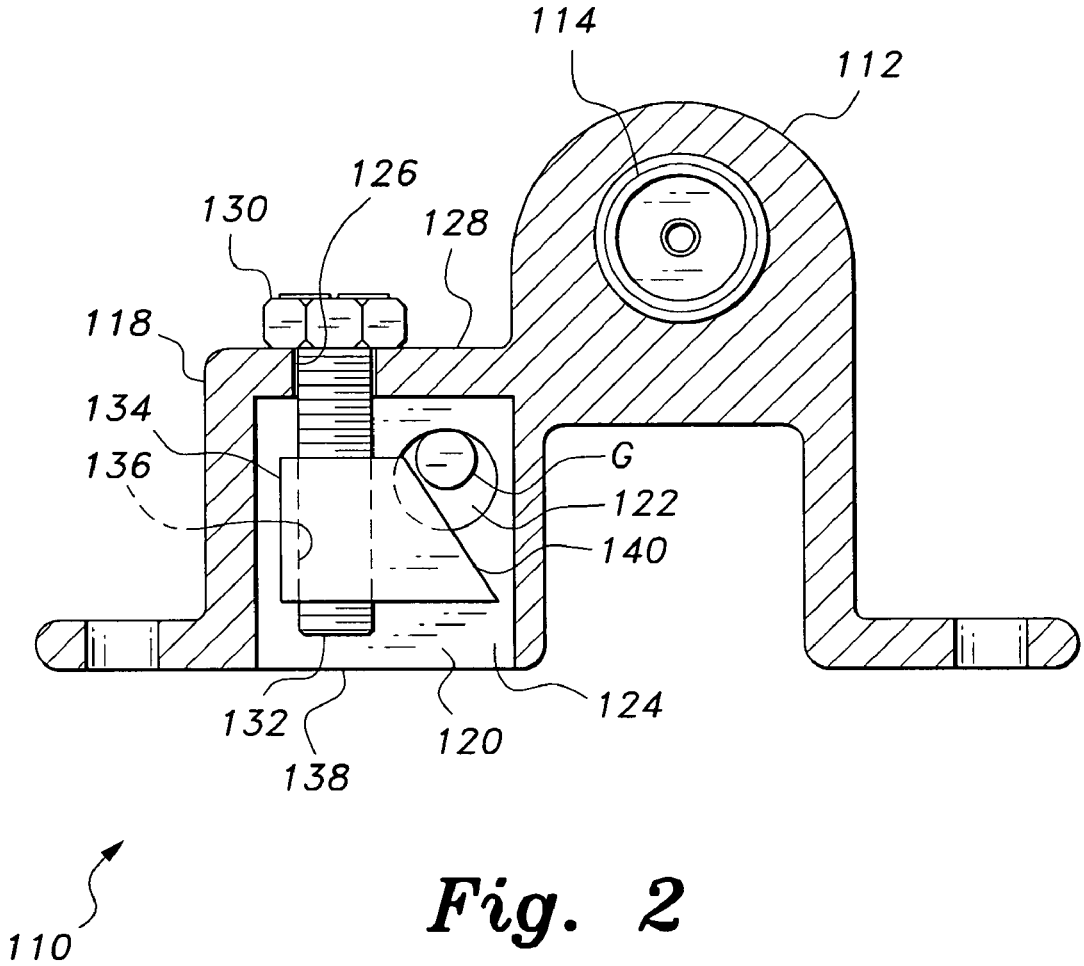
FIG. 2 is an enlarged side elevation view in section of the electrical bonding block of FIG. 1, showing various internal details of the grounding lug.

FIGS. 1 and 2 illustrate a first embodiment of the present electrical bonding block 110. The bonding block 110 includes a body 112 comprising a cylindrical barrel housing an insulator of polyethylene, polyvinyl chloride (PVC), ceramic or the like that encircles coaxial cable center contacts, the body 112 having first and second electrical conductor connection terminals, respectively 114 and 116, disposed thereon. In the example of FIGS. 1 and 2, the terminals 114 and 116 comprise mutually opposed externally threaded coaxial cable connectors, e.g., an F-81 coaxial cable coupler, but other electrical connector or terminal configurations may be incorporated into the bonding block 110 in accordance with the type of electrical conductors to be connected by the bonding block. The external threads of the connectors or terminals 114 and 116 are electrically grounded to the bonding block body 112 and provide for the grounding of the ground sheath, which conventionally surrounds the central conductor of coaxial cables, and which attaches to the externally threaded connectors 114, 116.

An electrical grounding lug 118 extends from the bonding block body 112, with the lug 118 providing for the mechanical and electrical connection of a ground wire G to the bonding block body 112. The grounding lug portion 118 joins both physically and electrically with the bonding block body portion 112, serving to conduct any ground current from the terminals 114, 116 through the body portion 112 and ground lug 118 to the ground wire G. The grounding lug 118 includes a hollow interior volume 120 therein, as shown in FIG. 2 of the drawings. A ground wire passage 122 is formed transversely through each of the opposite walls 124 of the ground lug portion 118 to pass through the ground lug, with the ground wire G being inserted into the ground wire passage 122 to ground the device 110.

A ground wire clamp screw passage 126 is formed through the intermediate wall 128 of the ground lug 118, i.e., the wall extending between the two opposed walls 124 with their ground wire passage 122. The clamp screw passage 126 is unthreaded, and its axis is laterally offset from the plane of the ground wire passage 122. A ground wire clamp screw 130 is inserted into the clamp screw passage 126, with the distal end 132 of the screw 130 residing in the hollow interior 120 of the ground lug 118 when the screw is installed.

A ground wire clamping chock 134 includes a threaded passage 136 therethrough, with the clamp screw 130 being threaded into the clamping chock passage 136. As the ground wire clamp screw 130 does not advance axially relative to the clamp screw passage 126 due to the lack of threads therein, it will be seen that rotation of the clamp screw 130 results in axial travel of the clamping chock 134 along the screw 130. The chock 134 cannot rotate relative to the ground lug 118, due to its confinement between the two opposed walls 124 of the lug.

The clamping chock 134 is installed into the interior 120 of the ground lug 118 through the open floor 138 thereof in the embodiment 110 of FIGS. 1 and 2, with the open floor 138 disposed opposite the ground screw passage 126 and serving as an access opening for the grounding lug interior 120. The ground wire clamp chock 134 preferably includes an angled or beveled ground wire contact portion 140, which is offset laterally from the clamp screw passage 136 of the chock and the ground wire clamp screw 130 threaded therethrough. Alternatively, the ground wire contact portion may comprise a flat surface orthogonal to the axis of the ground wire clamp screw 130, or may have some other configuration as desired. When the chock 134 is installed on the clamp screw 130, the ground wire passage 122 is positioned between the ground wire contact portion 140 of the chock 134 and the intermediate wall 128 of the grounding lug portion 118. Thus, as the ground wire clamp screw 130 is tightened in the chock 134, the chock is pulled upwardly along the threaded shank of the screw 130 to clamp the ground wire G securely between the ground wire contact portion 140 of the chock 134 and the generally opposite sides or edges of the ground wire passage 122 through the grounding lug portion 118 of the device, generally as shown in FIG. 2.

Figure 3:
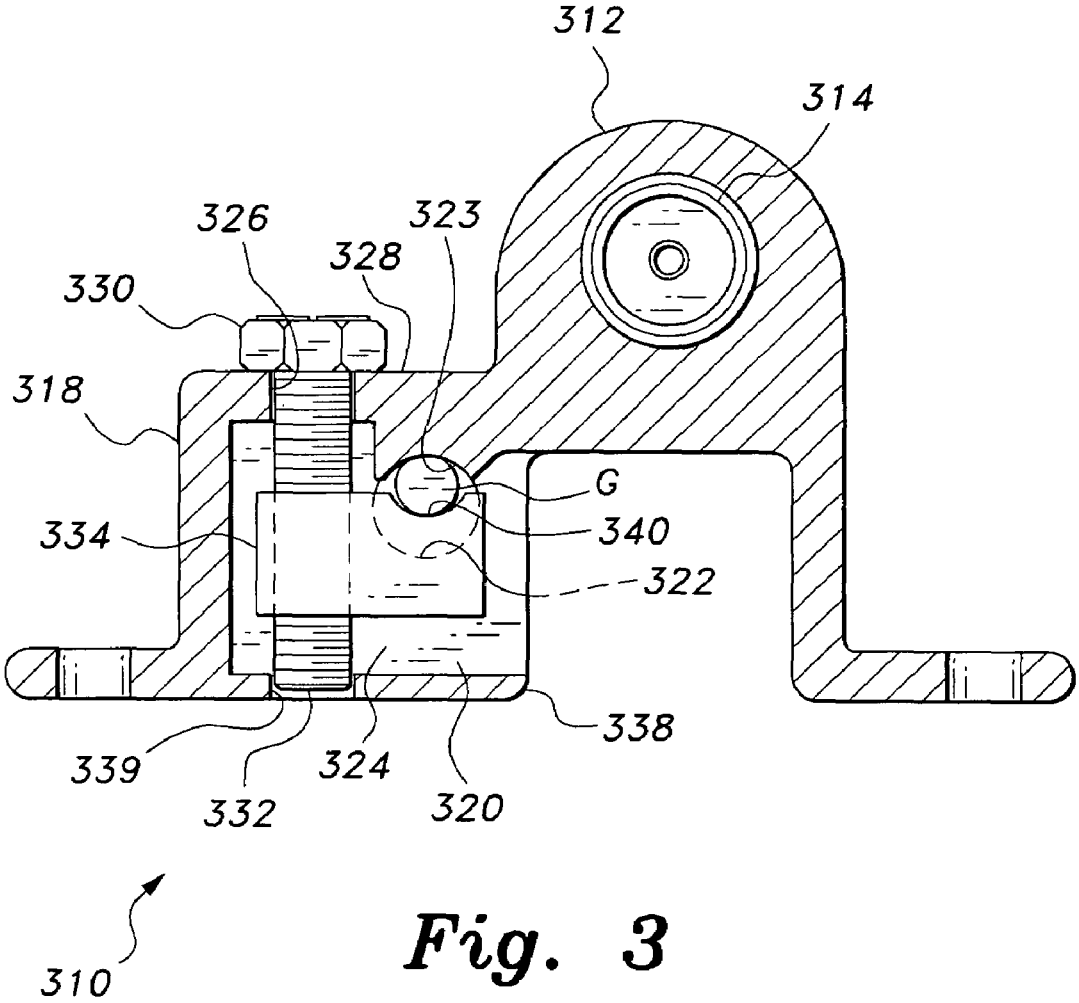
FIG. 3 is an enlarged side elevation view in section of an alternative embodiment of an electrical bonding block with grounding lug according to the present invention, showing an alternative configuration for the internal structure of the grounding lug portion.

The side elevation view in section of FIG. 3 illustrates various modifications to the device, resulting in a second embodiment of an electrical bonding block 310. The bonding block 310 of FIG. 3 is configured generally similarly to the embodiment 110 of FIGS. 1 and 2, with corresponding components being identified by three digit numerals differing only in the first digit, e.g., the bonding block 110 of FIGS. 1 and 2 vs. the bonding block 310 of FIG. 3. The electrical bonding block 310 of FIG. 3 includes a bonding block body 312 having mutually opposed first and second electrical conductor terminals extending therefrom. Only the first connector 314 is shown in the elevation view of FIG. 3, but it will be understood that this portion of the device 310 is identical to the corresponding portion of the bonding block 110 of FIGS. 1 and 2.

An electrical grounding lug 318 having a hollow interior 320 extends from the body 312, generally in the manner of the lug 118 and body 112 of the first embodiment 110. The grounding lug 318 includes a ground wire passage 322, which passes through the opposed lateral walls 324 (only one of which is shown in the sectional view of FIG. 3) of the lug. However, it will be noted that the passage 322 of the embodiment 310 of FIG. 3 differs from the passage 122 of the embodiment of FIGS. 1 and 2, with the passage 322 of FIG. 3 including a concave, semicylindrical channel 323 formed in or adjacent to the intermediate wall 328 forming the roof or top of the grounding lug portion 318. The ground wire channel 323 extends completely across the width of the grounding lug 318, as shown by the solid body representation of the channel in the cross sectional view of FIG. 3.

An unthreaded ground wire clamp screw passage 326 is formed through the upper intermediate wall 328 of the lug 318, with the ground wire clamp screw 330 installed in the clamp screw passage 326 as in the embodiment 110 of FIGS. 1 and 2. However, rather than having the distal end 332 of the screw 330 unsupported, as in the bonding block embodiment 110, the grounding lug 318 of FIG. 3 includes a closed floor 338 extending thereacross, serving as a distal support for the clamp screw 330. The floor 338 includes a screw distal end passage 339 therein or therethrough, opposite the clamp screw passage 326, with the distal end 332 of the screw 330 being captured within the passage 339 when the screw 330 is inserted completely into and through the hollow interior 320 of the grounding lug 318. Thus, as the ground wire clamp screw 330 is rotated within its passage 326 through the upper wall 328 of the grounding lug 318, the distal end 332 of the screw is captured or supported by the distal screw end passage 339 through the clamp screw support element or floor 328 of the device, relieving bending loads on the clamp screw 330 and the upper or lateral wall 328 through which the screw passes.

The ground wire chock 334 of the embodiment of FIG. 3 also differs somewhat from the chock 134 of the embodiment of FIGS. 1 and 2. Rather than having a tapered or beveled ground wire contact surface, the chock 334 of FIG. 3 includes a concave, semicylindrical ground wire contact portion 340. The combination of the semicylindrical concavity of the ground wire channel 323 and the semicylindrical concavity of the ground wire contact portion 340 of the chock 334 results in a generally congruent, more closely conforming contact of the channel 323 and ground wire contact portion 340 with the cylindrical shape of the ground wire G. This provides greater contact area between the wire and the bonding block device 310 for better electrical conductivity, and also better distributes the contact pressures on the ground wire to reduce deformation and imposition of stress risers on the wire. It will be understood that the various embodiments shown in FIG. 3 and described above may be incorporated in any of the other embodiments of the device as desired.

Figure 4:
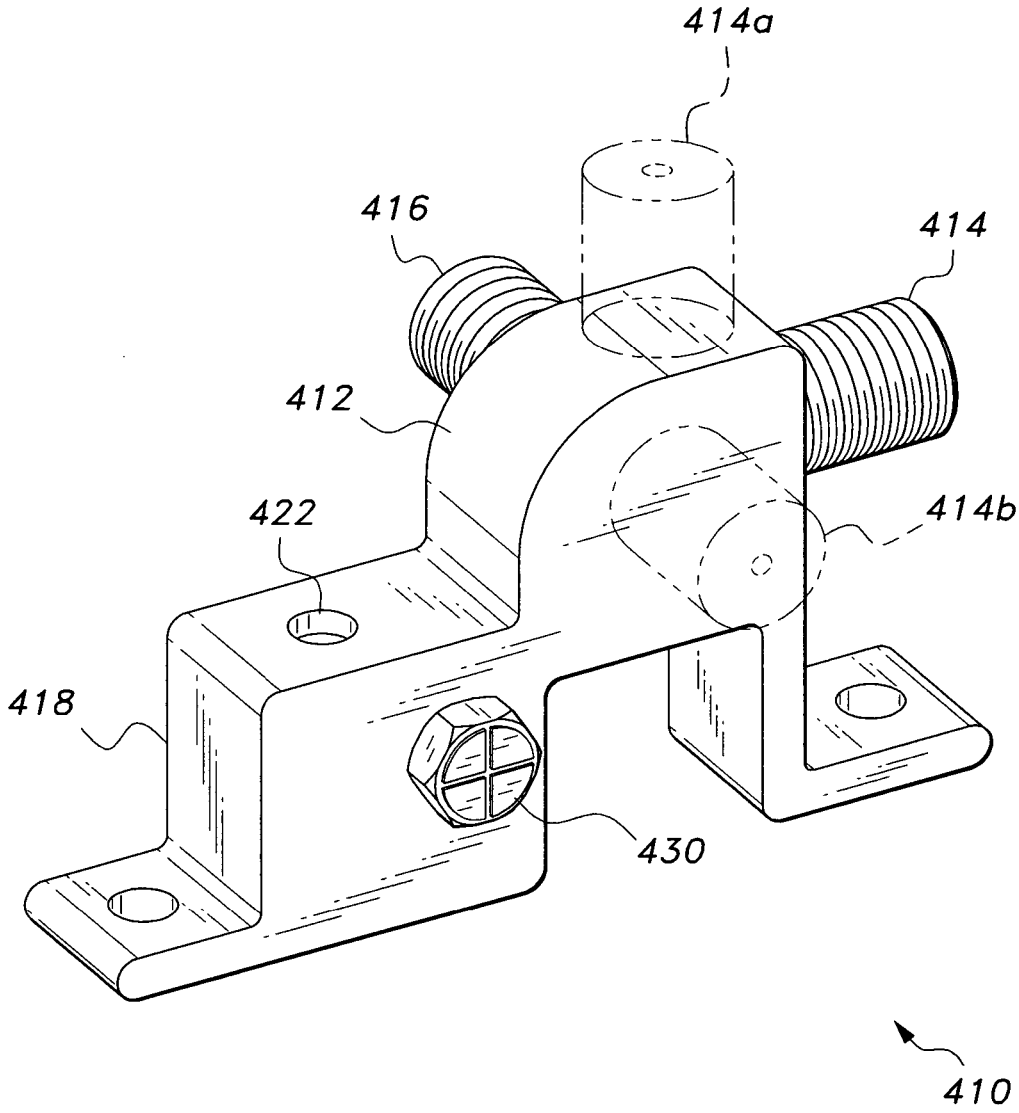
FIG. 4 is a perspective view of another alternative embodiment of an electrical bonding block with grounding lug according to the present invention, wherein the electrical conductor connectors are normal to one another and the ground wire passage is normal to the base of the device.

FIG. 4 of the drawings illustrates yet another embodiment of the present invention, comprising bonding block 410. Much of the structure of the bonding block 410 of FIG. 4 is identical with that of the bonding block 110 of FIGS. 1 and 2, with only the differing structure being described in the discussion of the bonding block 410 of FIG. 4. The bonding block 410 includes a bonding block body 412 having first and second electrical connector terminals, respectively 414 and 416, extending therefrom. However, while the second terminal 416 extends rearwardly from the body 412 in the perspective of the drawing Fig., as in the case of the embodiments of FIGS. 1 through 3, it will be noted that the first terminal connector 414 is disposed orthogonally relative to the second terminal. This option may be provided with any of the bonding block embodiments of the present invention, as desired. It will also be noted that the specific configuration shown in solid lines in FIG. 4 is not required, and that the first terminal connector 414 may be located as shown by the alternative orthogonal first connector position 414*a* or the coaxially disposed first connector position 414*b*, both shown in broken lines in FIG. 4.

The bonding block 410 of FIG. 4 also differs from the blocks of FIGS. 1 through 3 in that the orientation of the ground wire passage 422 and ground wire clamp screw 430 of the grounding lug portion 418 are orthogonal to the orientation of those corresponding components shown in FIGS. 1 through 3. This configuration, wherein the ground wire clamp screw 430 is axially parallel to the alternative first connector 414*b* and its coaxially disposed or aligned second connector 416, may be provided in any of the other embodiments of the present electrical bonding block, as desired. In the configuration of FIG. 4, the unseen distal end of the ground wire clamp screw 430 engages a support passage in the opposite, unseen lateral wall of the grounding lug 418. Clearance for the installation of the ground wire clamp chock may be provided by leaving the inner wall of the grounding lug 418 open.

Figure 5:
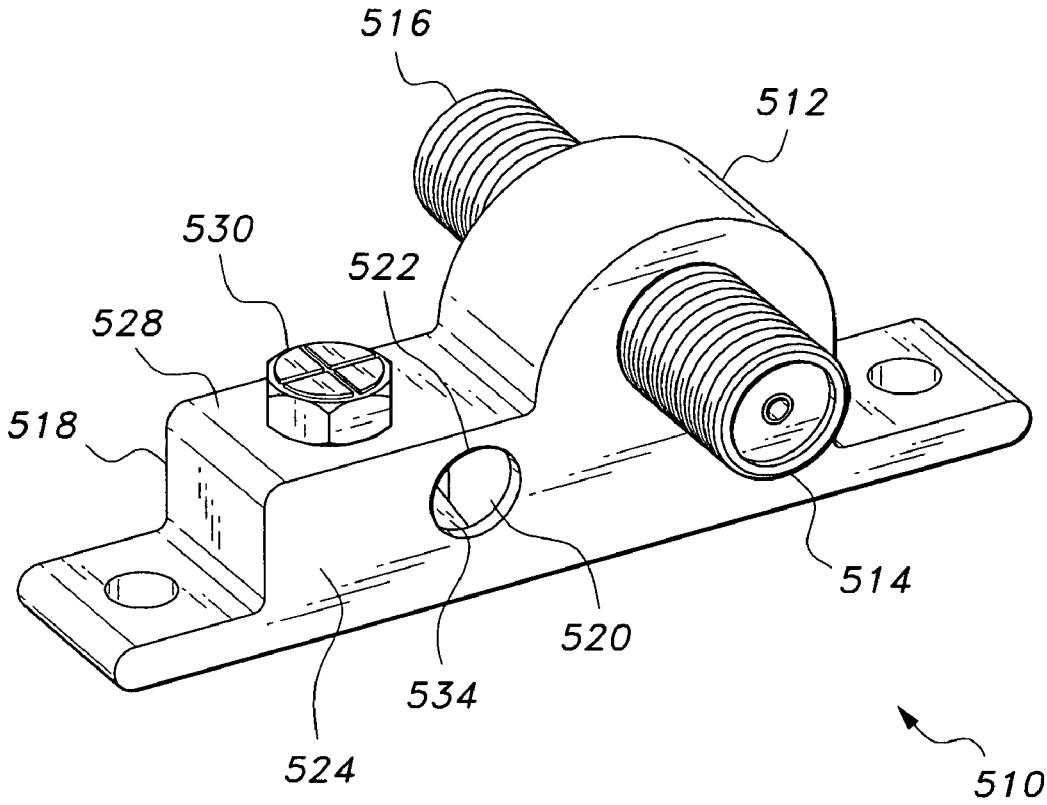
FIG. 5 is a perspective view of another alternative embodiment of an electrical bonding block with grounding lug according to the present invention, wherein the ground lug portion is generally coplanar with the electrical conductor connectors.

FIG. 5 of the drawings provides an illustration of still another embodiment of an electrical bonding block, comprising bonding block 510. The bonding block 510 is generally similar to the bonding block 110 of FIGS. 1 and 2, having a bonding block body 512 with first and second terminals, respectively 514 and 516, disposed thereon. The terminals may be coaxially aligned with one another, as shown, or may be orthogonal to one another, as in the embodiment of FIG. 4. The bonding lug portion 518 includes a hollow interior 520 having a ground wire passage 522 formed through the opposite walls 524 thereof. A ground wire clamp screw 530 extends through a clamp screw passage (not shown in FIG. 5, but similar to that shown for the embodiment 110 in FIG. 2) formed in the transverse intermediate wall 528, and engages a ground wire clamp chock 534 within the hollow interior 520 of the bonding lug 518.

The above-described configuration is essentially the same as that described in other embodiments of the present electrical bonding block. However, it will be noted that the bonding block 510 of FIG. 5 differs from other embodiments of the present invention by placing the bonding block body 512 essentially coplanar with the bonding lug 518. This lowers the overall height of the device, providing a more compact installation. Sufficient clearance is provided between the terminals 514 and 516 and the underlying base of the device to allow the larger connector end of the coaxial cable to be connected to the terminals, as required.

Figure 6:
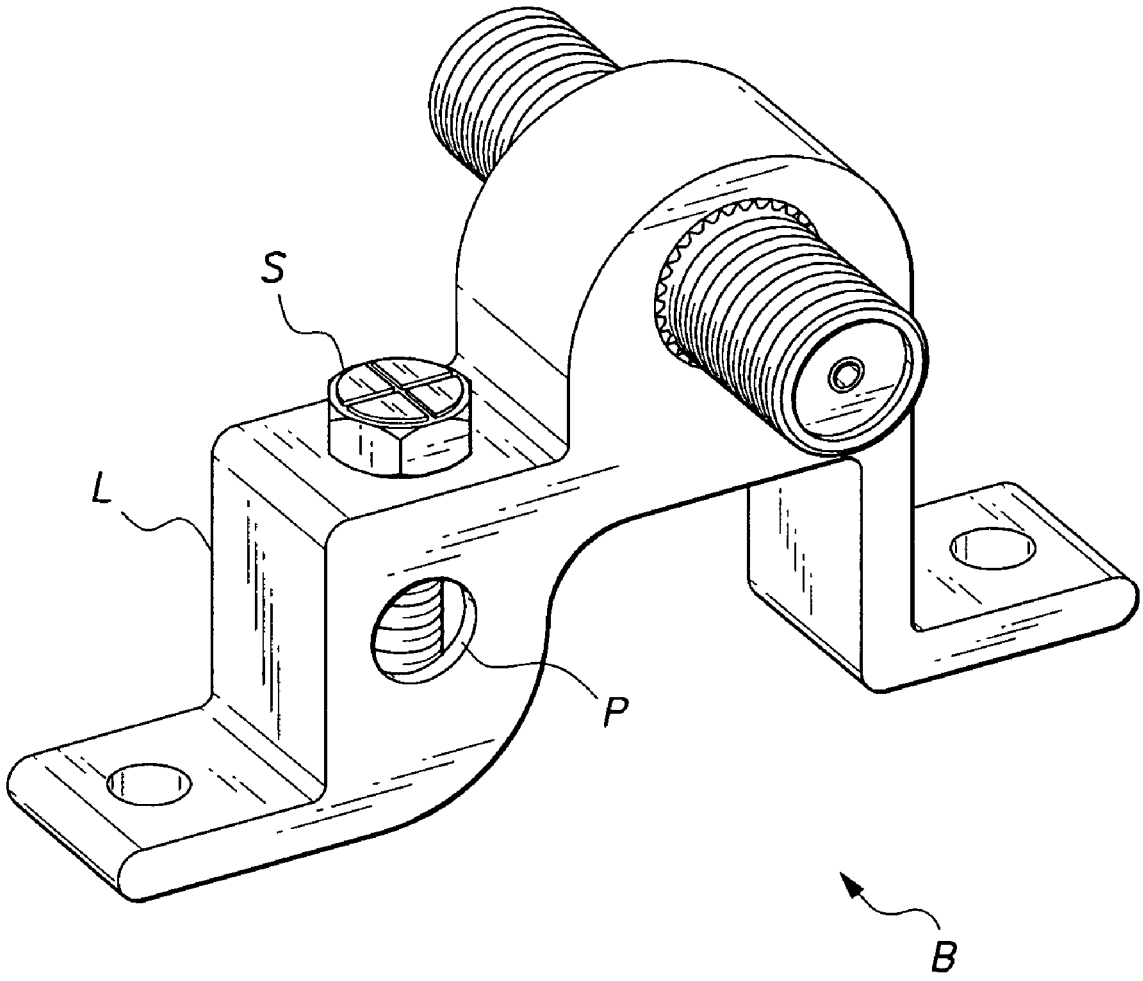
Fig. 6 Prior Art
FIG. 6 is a prior art perspective view of a conventional electrical bonding block, showing the conventional ground wire clamp screw, which is axially coplanar with the ground wire passage, directly engaging a ground wire installed in the passage.

FIG. 6 provides an illustration of a conventional bonding block B of the prior art. The grounding lug L of the bonding block B includes a ground wire passage P therethrough, with a ground wire clamp screw S disposed orthogonally to the passage P. It will be noted that in the conventional bonding block B, the ground wire clamp screw S lies in the same plane as the ground wire passage P. Thus, the screw S engages a ground wire directly as it passes through the ground wire passage P, with the direct engagement of the ground wire screw against the ground wire resulting in the production stress risers, work hardening, and general reduction in the security of the installation of the ground wire in the bonding block.

In conclusion, the electrical bonding block of the present invention in its various embodiments provides a much more secure means of electrically bonding a ground wire to the electrical ground of another electrical conductor or device. The reduction of high point pressures on the relatively soft metal of the ground wire greatly reduces the deformation of the wire and resulting stress risers, thus reducing work hardening of the ground wire, stress corrosion, and other factors which cause the connection to loosen and the electrical continuity of the ground wire connection to be lost. Accordingly, the electrical bonding block will prove to be a most useful advance in such devices.

It is to be understood that the present invention is not limited to the embodiments described above, but encompasses any and all embodiments within the scope of the following claims.

I claim:

1. An electrical bonding block with grounding lug, comprising:

a bonding block body;

first and second electrical conductor connection terminals disposed upon the bonding block body;

an electrical ground lug extending from the bonding block body, the ground lug having a hollow interior volume defined therein, a ground wire passage disposed transversely therethrough, and a ground wire clamp screw passage substantially normal to and offset from the ground wire passage, wherein the ground wire passage is at least partially defined by a concave channel extending completely across and through said electrical ground lug;

a ground wire clamp screw disposed within the ground wire clamp screw passage and extending into the interior of the electrical ground lug; and a ground wire clamping chock threaded upon the ground wire clamp screw, the ground wire passage being disposed substantially between the ground wire clamp screw passage and the ground wire clamp screw, the ground wire clamping chock having a ground wire contact portion laterally offset from the ground wire clamp screw.

2. The electrical bonding block with grounding lug according to claim 1, wherein said electrical ground lug has an access opening opposite the ground wire clamp screw passage thereof.

3. The electrical bonding block with grounding lug according to claim 1, further including a ground wire clamp screw distal support disposed opposite the ground wire clamp screw passage of said electrical ground lug, a distal end of said ground wire clamping screw being rotationally supported within said ground wire clamp screw distal support.

4. The electrical bonding block with grounding lug according to claim 1, wherein the ground wire contact portion of said ground wire clamping chock is concave, being adapted for substantially conforming to a ground wire disposed within the ground wire passage.

5. The electrical bonding block with grounding lug according to claim 1, wherein said first and second electrical conductor connection terminals comprise externally threaded coaxial cable connectors.

6. The electrical bonding block with grounding lug according to claim 1, wherein said first and second electrical conductor connection terminals are mutually orthogonal to each other.

7. The electrical bonding block with grounding lug according to claim 1, wherein said ground wire clamp screw is axially parallel to said first and second electrical conductor connection terminals.

8. An electrical bonding block with grounding lug, comprising:

a bonding block body;

first and second electrical conductor connection terminals disposed upon the bonding block body;

an electrical ground lug extending from the bonding block body, the ground lug having a hollow interior volume defined therein, a ground wire passage disposed transversely therethrough, a ground wire clamp screw passage substantially normal to and offset from the ground wire passage, and an access opening opposite the ground wire clamp screw passage, wherein the ground wire passage is at least partially defined by a concave channel extending completely across and through said electrical ground lug;

a ground wire clamp screw disposed within the ground wire clamp screw passage and extending into the interior of the electrical ground lug; and a ground wire clamping chock threaded upon the ground wire clamp screw, the ground wire passage being disposed substantially between the ground wire clamp screw passage and the ground wire clamp screw, the ground wire clamping chock having a ground wire contact portion laterally offset from the ground wire clamp screw.

9. The electrical bonding block with grounding lug according to claim 8, wherein the ground wire contact portion of said ground wire clamping chock is concave, being adapted for conforming to a ground wire disposed within the ground wire passage.

10. The electrical bonding block with grounding lug according to claim 8, wherein said first and second electrical conductor connection terminals comprise externally threaded coaxial cable connectors.

11. The electrical bonding block with grounding lug according to claim 8, wherein said first and second electrical conductor connection terminals are mutually orthogonal to each other.

12. The electrical bonding block with grounding lug according to claim 8, wherein said ground wire clamp screw is axially parallel to said first and second electrical conductor connection terminals.

13. An electrical bonding block with grounding lug, comprising:

a bonding block body;

first and second electrical conductor connection terminals disposed upon the bonding block body;

an electrical ground lug extending from the bonding block body, the ground lug having a hollow interior volume defined therein, a ground wire passage disposed transversely therethrough, a ground wire clamp screw passage substantially normal to and offset from the ground wire passage, and a ground wire clamp screw distal support disposed opposite the ground wire clamp screw passage, wherein the ground wire passage is at least partially defined by a concave channel extending completely across and through said electrical ground lug;

a ground wire clamp screw disposed within the ground wire clamp screw passage and extending into the interior of the electrical ground lug, the ground wire clamp screw having a distal end supported within the ground wire clamp screw distal support of the electrical ground lug; and a ground wire clamping chock threaded upon the ground wire clamp screw, the ground wire passage being disposed substantially between the ground wire clamp screw passage and the ground wire clamp screw, the ground wire clamping chock having a ground wire contact portion laterally offset from the ground wire clamp screw.

14. The electrical bonding block with grounding lug according to claim 13, wherein the ground wire contact portion of said ground wire clamping chock is concave, being adapted for conforming to a ground wire disposed within the ground wire passage.

15. The electrical bonding block with grounding lug according to claim 13, wherein said first and second electrical conductor connection terminals comprise externally threaded coaxial cable connectors.

16. The electrical bonding block with grounding lug according to claim 13, wherein said first and second electrical conductor connection terminals are mutually orthogonal to each other.

17. The electrical bonding block with grounding lug according to claim 13, wherein said ground wire clamp screw is axially parallel to said first and second electrical conductor connection terminals.

* * * * *